US005341162A

United States Patent [19]

Hermanson et al.

[11] Patent Number: 5,341,162

[45] Date of Patent: Aug. 23, 1994

[54] LIQUID DEAGASSING APPARATUS

[75] Inventors: Herman A. Hermanson, Penfield; Donald J. Drake, Rochester; Ivan Rezanka, Pittsford; Robert S. Karz, Webster; Roger G. Teumer, Fairport; Robert P. Altavela, Pittsford, all of N.Y.

[73] Assignee: Xerox Corporation, Stamford, Conn.

[21] Appl. No.: 933,560

[22] Filed: Aug. 24, 1992

[51] Int. Cl.[5] ..... B41J 2/01

[52] U.S. Cl. ..... 347/92; 347/82

[58] Field of Search ..... 346/140 R

[56] References Cited

U.S. PATENT DOCUMENTS

| | | | |
|---|---|---|---|
| 4,301,459 | 11/1981 | Isayama et al. | 346/140 R |
| 4,454,518 | 6/1984 | Bangs | 346/140 R |
| 4,638,337 | 1/1987 | Torpey et al. | 346/140 R |
| 4,896,172 | 1/1990 | Nozawa et al. | 346/140 R |
| 4,929,963 | 5/1990 | Balazar | 346/1.1 |
| 4,980,702 | 12/1990 | Kneezel et al. | 346/140 R |
| 5,121,130 | 6/1992 | Hempel et al. | 346/1.1 |

FOREIGN PATENT DOCUMENTS

| | | | |
|---|---|---|---|
| 61-02445 | 8/1986 | Japan | 346/140 R |

*Primary Examiner*—Benjamin R. Fuller
*Assistant Examiner*—Valerie Ann Lund
*Attorney, Agent, or Firm*—Robert A. Chittum

[57] ABSTRACT

Disclosed is an apparatus for degassing a liquid, comprising: a liquid supply and an outlet communicating with the liquid supply via a flow path; a degassing tank, disposed in the flow path between the liquid supply and the outlet, the degassing tank incorporating a gas-permeable vent; a means for moving the liquid along the flow path; and a heater, disposed in the flow path between the degassing tank and the outlet, for heating the liquid and thereby removing gas therefrom. The apparatus is particularly suited to the ink supply system of a thermal ink jet printer where the removal of gases dissolved in the ink improves print quality.

15 Claims, 2 Drawing Sheets

LIQUID DEAGASSING APPARATUS

BACKGROUND OF THE INVENTION

The present invention relates generally to a liquid degassing apparatus, and more particularly to a degassing apparatus in the ink supply system of a thermal ink jet printing device.

A thermal ink jet printer has at least one printhead in which thermal energy pulses are used to produce vapor bubbles in ink-filled channels and so cause droplets of ink to be expelled from the channel orifices towards a recording medium. The thermal energy pulses are usually produced by resistors, each located in a respective one of the channels, which are individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates form the bulging ink which forms a droplet moving in a direction away from the channel and towards the recording medium. The channel is then refilled by capillary action, which in turn draws ink from a supply container. It is conventional to provide an arrangement to clean the channel orifices periodically while the printhead is in use and to close-off the orifices when the printhead is idle to prevent ink in the printhead from drying out.

One form of thermal ink jet printer is described in U.S. Pat. No. 4,638,337 to Torpey et al. That printer is of the carriage type and has a plurality of printheads, each with its own ink supply cartridge, mounted on a reciprocating carriage. The channel orifices in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information. As an alternative to providing each printhead with its own ink cartridge, the printheads can be supplied with ink from one or more supply tanks which need not be mounted on the carriage.

U.S. Pat. No. 4,454,518 refers to the importance of temperature control in an ink jet printer and, in particular, the control of the ink temperature in a printer of the type that utilizes a piezoelectric transducer to cause the discharge of ink droplets from a printhead. U.S. Pat. No. 4,929,063 describes the cooling of the printhead of a thermal inkjet printer by causing ink to flow through the printhead in a volume far greater than that required for printing purposes. Temperature control of thermal inkjet printheads is also discussed in U.S. Pat. Nos. 4,896,172 and 4,980,702.

U.S. Pat. No. 5,121,130 to Hempel et al. discloses a printhead assembly for a thermal ink jet printer in which the ink supply path carrying ink to the printhead passes through, and receives heat form, a heat sink adjacent the print heaters of the printhead. The ink then passes to the printhead via a secondary reservoir, the position of which relative to the printhead establishes the ink pressure at the printhead discharge orifices. Capping means is provided to cap the discharge orifices when the printhead is idle and to purge ink from the printhead when required.

Problems arise with ink jet printers which are known in the art due to dissolved gases being present in the ink in the ink reservoir. As well as making it difficult to control the temperature of the ink, the dissolved gases can have a significant effect on the amount of ink expelled in a droplet when the ink near a channel orifice is heated, and on the manner of its expulsion, thereby reducing print quality. When a heater resistor near a channel orifice is addressed, dissolved gases in the vicinity expand and even merge with the ink vapor bubble, thereby distorting the vapor bubble, and therefore the ink droplet, from its optimum volume and shape. Also, in ink jet printers it is conventional to maintain a negative pressure at the printhead; the presence of air bubbles may make this difficult. A degree of resistance to flow of the ink may also be produced by dissolved gas bubbles, particularly when collected around filter screens so that capillary refill is impeded or blocked.

The present invention seeks to provide a liquid degassing apparatus for removing gases dissolved in a liquid. The present invention further seeks to provide an ink degassing system in the ink supply system of an ink jet printer. The present invention further seeks to provide ink supply system of an ink jet printer in which the ink temperature and the amount of dissolved gas in the ink is precisely controlled.

SUMMARY OF THE INVENTION

The present invention provides an apparatus for degassing a liquid, comprising: a liquid supply and an outlet communicating with the liquid supply; a degassing tank, disposed between the liquid supply and the outlet, the degassing tank incorporating a gas-permeable vent; a means for recirculating the liquid; and a heater, disposed between the degassing tank and the outlet, for heating the liquid and thereby removing gas therefrom. The liquid may comprise ink (or any other liquid) and the outlet may be connected to the printhead of an ink jet printer.

Preferably, the outlet is connected to the degassing tank at the base thereof, and the heater is disposed adjacent the base. Preferably, the degassing tank comprises an overflow tank having an inlet, an overflow outlet and a supply outlet, the degassing tank being arranged with the supply outlet disposed below the level of the overflow outlet. Preferably, the overflow outlet is connected to the liquid supply. Alternatively, the level of the liquid may be maintained by means of a level sensor and control system linked to the recirculating means, such as a pump. Preferably, the overflow tank is mounted near but slightly below the outlet (and therefore the printhead) so as to maintain a negative pressure of, for example, −1 inch (−25.4 mm) of water at the printhead.

Preferably, the flow path between the supply outlet of the degassing tank and the outlet is provided by a gas-impermeable conveyance, e.g. a stainless steel or teflon pipe.

In one embodiment, the heater comprises metal wire or foil extending around the periphery of the flow path. The wire or foil may be mounted inside or outside the hose. Preferably, the wire or foil extends from the degassing tank for a distance along the flow path, the distance being selected to achieve optimum heating of the ink. In another embodiment, the heater is an immersible heater located in the degassing tank or flow path and upstream from a filter.

Preferably, a filter is provided in the flow path, between the heater and the outlet. The filter may comprise any suitable conventional filter.

Preferably, the vent includes a membrane which is impermeable to the liquid, but permeable to air or gas. The membrane may be formed of Goretex TM fabric.

According to another aspect of the present invention there is provided an apparatus for degassing a liquid, comprising: a liquid supply, an overflow tank and a pump for circulating the liquid from the supply to the tank and back via an overflow outlet to the supply, the overflow tank providing above the liquid an airspace which is vented to the atmosphere and an outlet below the surface of the liquid for delivering degassed liquid, the outlet having associated therewith a heater for heating and degassing the liquid.

According to another aspect of the present invention there is provided an ink supply system for an ink jet printer, incorporating a degassing apparatus as described above.

BRIEF DESCRIPTION OF THE DRAWINGS

An embodiment of the invention will be described, by way of example, with reference to the accompanying drawing, in which.

DESCRIPTION OF THE PREFERRED EMBODIMENT

Figure 1:
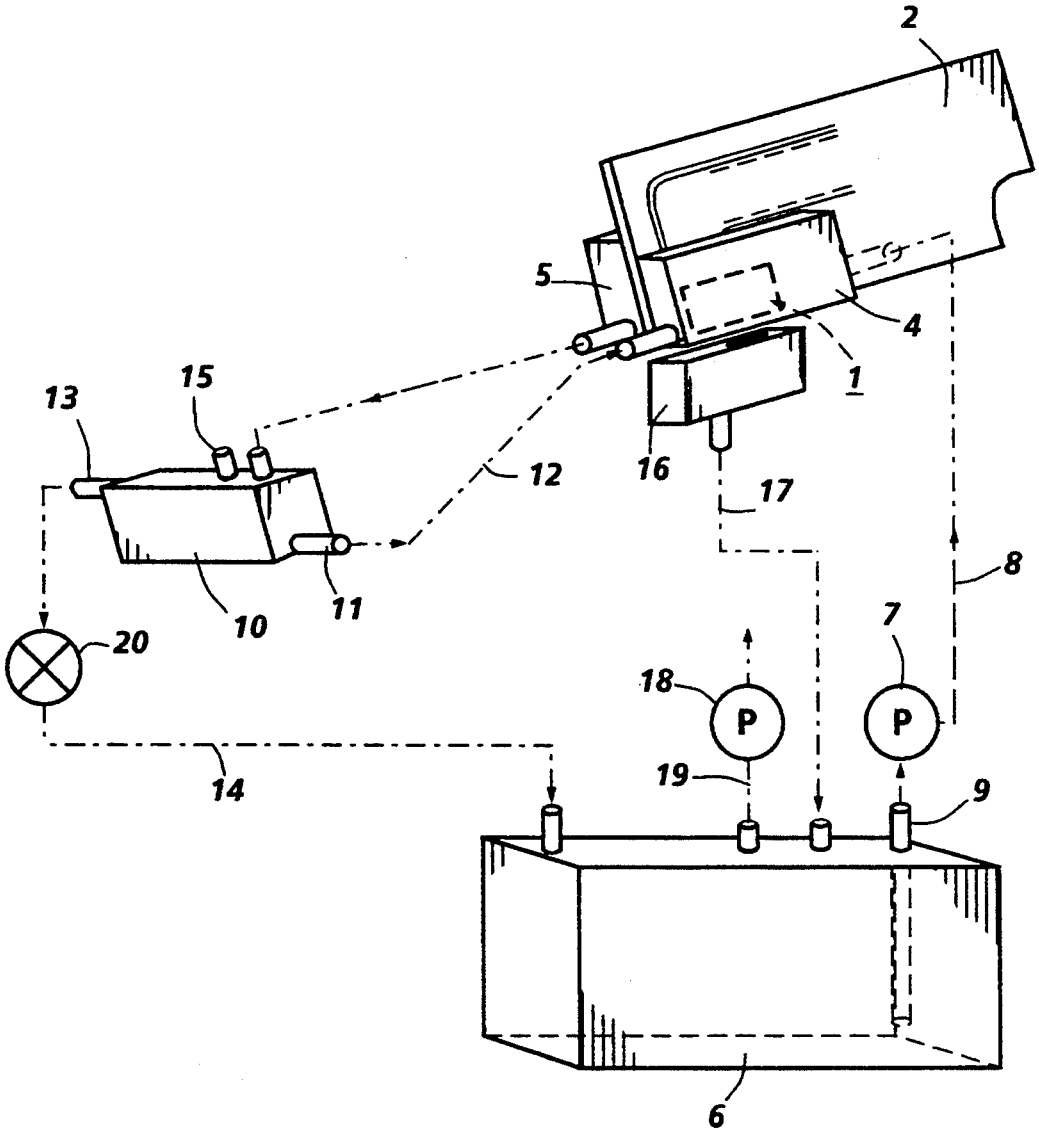
FIG. 1 is a diagram of a thermal ink jet printer including an ink supply system.

The printhead 1 of the assembly, which is shown in FIG. 1 in dashed line, is mounted on electrode board 2 and can be of any conventional type, and a suitable printhead is disclosed in U.S. Pat. No. 5,121,130 to Hempel et al., which is incorporated herein by reference.

The ink supply for the printhead 1 (shown in dashed line) is contained in a main supply tank 6. Ink is delivered from the tank by a pump 7 located in a line 8 that extends from the tank outlet 9 and through the heat sink 5 to a secondary supply tank 10, which is described in greater detail below. If the main supply tank is located above the heat sink and the secondary supply tank, the ink may be delivered by gravity. A supply outlet 11 at the bottom of the secondary tank 10 is connected by a line 12 to deliver ink to the printhead adaptor block 4 while a return outlet 13 at the top of the secondary tank is connected by a line 14 to return ink to the main supply tank 6. On the top of the secondary tank 10 there is an air vent 15.

Ink delivered to the printhead adaptor block 4 passes, via fill holes (not shown), into the manifold in the printhead. The ink channels in the printhead are filled from that manifold by capillary action in the usual way.

A maintenance station 16 for the printhead is connected to a respective port in the top of the main tank 6 by a line 17. A vacuum pump 18, which is associated with operation of the maintenance station 16 as will be described below, is also connected to a respective port in the top of the main tank, by a line 19.

It will be understood that the system may include fluid filters as appropriate in the ink flow lines, for example in the supply and return lines 8, 14 and in the printhead adaptor block 4.

Operation of the printhead assembly shown in FIG. 1 will now be described and, initially, it will be assumed that the printer of which the assembly forms part is already in operation so that the pump 7 is running and ink is being drawn from the main tank 6. The pump 7 delivers ink to the secondary tank 10 at a rate which, under all conditions, is at least equal to the rate at which ink is withdrawn from the overflow tank for printing (i.e. via the supply outlet 11). Consequently, the ink level within the secondary tank 10 may rise and, if it reaches the return outlet 13, excess ink is returned to the main tank via the line 14.

At the printhead 1, drops of ink are discharged from the channel orifices by the formation of vapor bubbles within the ink channels in known manner. Following each discharge, the channel is re-filled by capillary action from the adaptor block 4 which, as already described, receives ink from the secondary tank 10.

During its passage from the main tank 6 to the secondary tank 10, the ink passes through the heat sink 5 of the printhead, close to the heater resistors in the ink channels, and is heated. Consequently the ink arrives at the secondary tank 10 with a higher temperature than the ink in the main tank 6 and is, accordingly, more suited to the elevated temperature at which the printhead 1 is operated.

The maintenance station 16, the construction of which is conventional, will not be described in detail; for more information on a typical maintenance station refer to U.S. Pat. No. 5,121,130. It will be appreciated that the maintenance station 16 could be connected to a vacuum pump 18 directly instead of through the tank 6 as shown in the drawing. However, the arrangement shown has the advantage that any ink drawn from the printhead during a cleaning operation flows directly into the tank 6 while ensuring that the return outlet 13 of the secondary tank is connected to a source of suction (via the top of the main tank) to prevent overfilling.

It is generally accepted that the ink pressure at the channel orifices in the printhead should be maintained at a slightly reduced level, typically in the range of from −0.2 to −2.0 inches. (−0.5 to −5.1 cms) of water. In the arrangement shown in FIG. 1, the location of the secondary tank 10 relative to the channel orifices determines the ink pressure at the latter and is adjusted to ensure that a negative pressure head is established and that the desired ink pressure at the channel orifices is achieved. The possibility of pressure surges occurring in the ink is reduced by the venting of the secondary tank 10 to atmosphere, at 15.

The arrangement shown in FIG. 1 enables effective control of the printhead temperature to be achieved.

An arrangement as shown in FIG. 1 can be used in a carriage-type printer as described and is also applicable to large, stationary arrays of printheads with large common heat sinks and remote ink supplies such as are found in pagewidth printers. In a color printer, a plurality of printheads (typically four) is provided, each assembly being as shown in FIG. 1 and being used to discharge ink of a particular color. Certain components of the system shown in FIG. 1 can also be shared by some or all of the printheads. For example, a single vacuum pump 18 only is required, even when (as, for example, in a color printer) there is more than one main tank 6. During priming, pump 7 need not be operated and optional valve 20 is closed, so that ink removed by priming is withdrawn from secondary tank 10.

Figure 2:
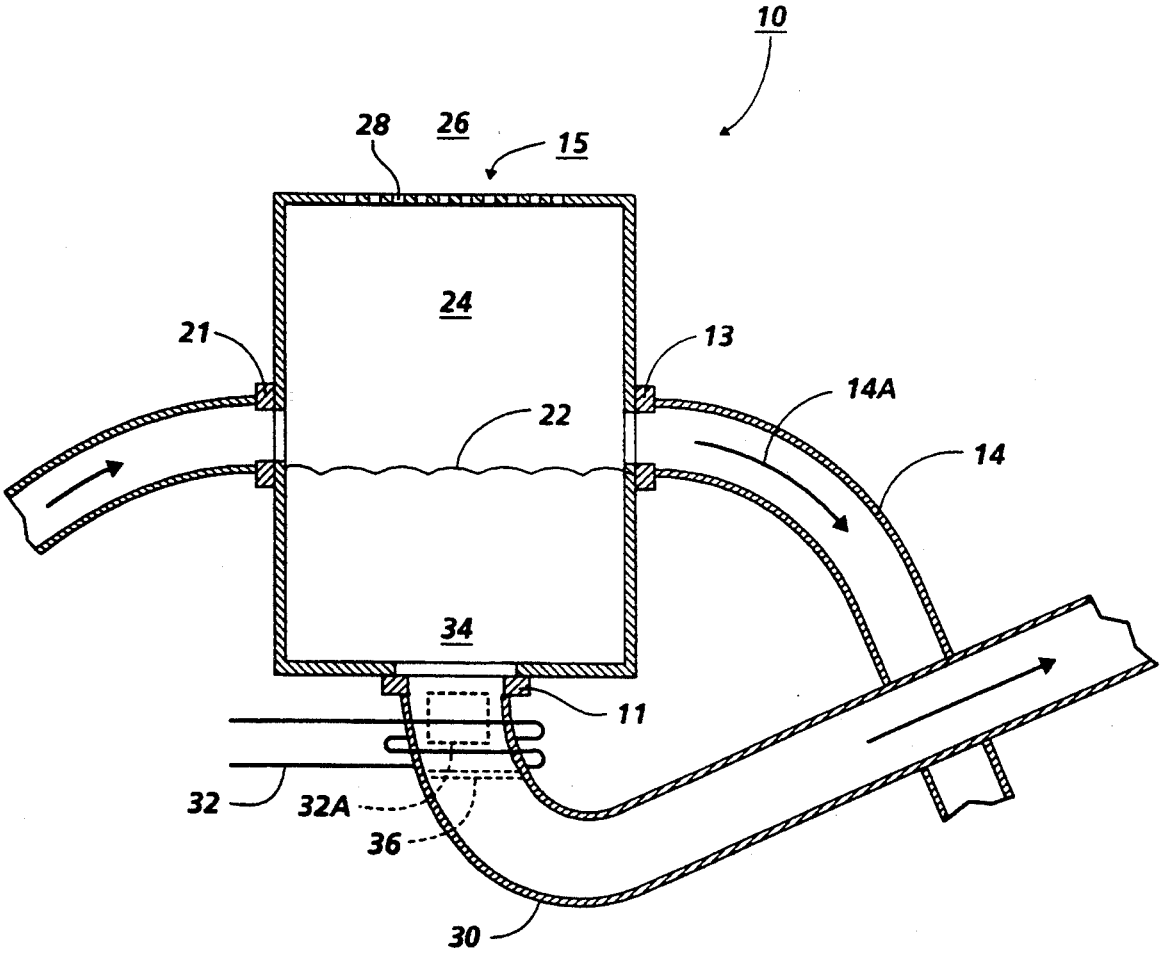
FIG. 2 illustrates a degassing apparatus used in the ink supply system shown in FIG. 1.

Referring to FIG. 2, this shows the liquid degassing apparatus in accordance with the present invention, as used in the ink supply system of FIG. 1. The basic component of the degassing apparatus is the secondary tank 10 which functions as an overflow tank. The tank 10 receives at its inlet 21 a liquid such as ink 34 which is pumped from the liquid supply 6 through heat sink 5 by pump 7. The overflow outlet 13 is at the same height as the inlet 21 so that the ink forms a surface 22 at about the same level; any excess ink flows through the overflow outlet 13 and is returned to the liquid supply 6 via line 14 as indicated by arrow 14A. The tank 10 is mounted relative to the printhead 1 in such a way as to maintain a negative pressure of about −1 in (−25.4 mm) at the printhead.

Above the surface of the liquid ink is a space 24 from which gas can escape to the atmosphere 26 through vent 15. A semi-permeable membrane (Goretex TM fabric) 28 is stretched across vent 15; the membrane permits the escape of gas but prevents the escape of liquid ink through the vent 15.

A gas-impermeable stainless steel tubing 30 is connected to the supply outlet 11 of the tank 10. At the junction of the tubing 30 with the supply outlet 11 several turns of resistive wire 32 are wound around the tubing 30 and connected to a suitable power supply (not shown), thereby forming a means for heating the ink 34 in the vicinity of the supply outlet 11. The wire 32 extends about 0.25 to 0.75 inch (6.4 to 19 mm) along the tubing 30. In operation, the heating of the ink 34 causes gases dissolved in the ink 34 to come out of solution and rise into the space 24, pass through the membrane 28 into the atmosphere 26, prior to the ink reaching the exit filter 36 (see below). Thus the ink passing to the printhead 1 along tubing 30 is substantially free of dissolved gases and remains that way. Should any trapped air bubbles be introduced downstream from the filter, the degassed ink will absorb it. To provide a further means of ensuring that trapped gases and/or impurities are not passed to the printhead, the filter 36 is arranged in the flow path of the ink 34, downstream of the heater wire 32.

The length of tubing 30 between the supply outlet 11 and the filter 36 should be long enough to ensure that any released gas will rise into space 24 in secondary tank 10 rather than travel downstream to the filter. The filter would stop any outgassed bubbles from passing therethrough and, thus, prevent them from entering the printhead, but gas bubbles collected or trapped on the filter surface would impede the flow of ink therethrough. Accordingly, the tubing 30 diameter and length between the outlet 11 and filter 36 must be selected to enable very small gas bubbles to join together to form larger bubbles which would tend to escape into the space 24 in secondary tank 10 prior to being drawn to the filter 36. One method to ensure this gas bubble control is to provide roughened surface sites (not shown) in the heated zone, as on the interior of the tubing 30, so that gas bubbles readily nucleate thereon (i.e., on the irregular surface of the roughened areas). Readily nucleated bubbles tend to grow and join together to form larger bubbles which more quickly move upward towards the space 24 in secondary tank 10. Alternatively, an immersion heater 32A could be used to heat the ink at a location either in the tubing 30 upstream from the filter 36 or in the bottom of the secondary tank near the outlet 11, whereby the ink passing the heated zone and approaching the filter is substantially degassed. The immersion heater could also have the roughened nucleation sites which readily nucleate and grow bubbles.

The present disclosure has been made only by way of example and numerous changes in details of construction, as well as different combinations and arrangements of parts, may be made without departing from the true spirit and scope of the invention as hereinafter claimed.

We claim:

1. An apparatus for degassing a liquid, comprising:

a main liquid supply tank having an inlet and an outlet and having a supply of liquid contained therein;

a liquid discharger communicating with the main tank outlet by way of a flow path;

means for moving the liquid along the flow path;

a secondary liquid supply tank disposed in the flow path between the main tank outlet and the liquid discharger for receiving liquid from the main tank and for supplying liquid to the liquid discharger, the secondary tank having a base with a supply outlet therein, an inlet, an overflow outlet, and a top with a gas-permeable vent therein, the vent comprising a membrane which is impermeable to the liquid, the secondary tank inlet and overflow outlet being disposed above the supply outlet and below the secondary tank top, so that a predetermined supply of liquid is contained in the secondary tank with an air space being formed thereover which is adjacent the secondary tank top, the secondary tank inlet communicating with the main tank outlet, the secondary tank supply outlet communicating with the liquid discharger, and the secondary tank overflow outlet communicating with the main tank inlet for returning liquid to the main tank when the liquid in the secondary tank rises to said overflow outlet, so that the means for moving the liquid cannot overfill the secondary tank; and a heater disposed at a position along the flow path between the secondary tank supply outlet and the liquid discharger and adjacent the supply outlet for heating the liquid to cause any dissolved or entrained gas in the liquid to rise to the air space in the secondary tank and be removed therefrom by the vent in the secondary tank top.

2. An apparatus according to claim 1, wherein the flow path between the secondary tank supply outlet and the liquid discharger is provided by a gas-impermeable tubing, the tubing having an interior surface and an outer periphery.

3. An apparatus according to claim 2, wherein the heater comprises metal wire or foil extending around the periphery of the tubing.

4. An apparatus according to claim 3, wherein the wire or foil extends for a predetermined distance along the tubing, thereby surrounding a portion of the tubing adjacent the secondary tank supply outlet.

5. An apparatus according to claim 2, wherein a filter is provided in the tubing between the heater and the liquid discharger and adjacent the heater.

6. An apparatus according to claim 5, wherein the liquid comprises ink, and wherein the liquid discharger comprises an ink jet printhead.

7. An apparatus according to claim 6, wherein the secondary tank is located at a predetermined location relative to the printhead to ensure that a negative pressure is established at the printhead.

8. An apparatus according to claim 7, wherein a printhead adaptor block is connected to the tubing from the secondary tank downstream from the filter and intermediately adjacent the printhead for receiving the filtered ink and delivering said ink to the printhead.

9. An apparatus according to claim 7, wherein internal roughened nucleation sites are provided on the interior surface of the tubing at a location in which the ink is heated, so that gas bubbles readily nucleate thereon and grow to form larger bubbles which more quickly move upwards towards the air space in said secondary tank.

10. An apparatus according to claim 9, wherein the heater comprises metal wire or foil extending around the outer periphery of the tubing for a predetermined distance along the tubing, thereby surrounding a portion of the tubing adjacent the secondary tank supply outlet; and wherein the portion of tubing being heated and having the filter are vertically disposed and substantially aligned with the secondary tank supply outlet to ensure that any released gas bubbles will rise into the air space of the secondary tank rather than travel downstream towards the filter where the gas bubbles could collect and impede the flow of ink therethrough.

11. An apparatus according to claim 10, wherein the means for moving the ink is a pump.

12. An apparatus according to claim 5, wherein the heater is disposed within the the tubing; wherein the heater has a surface, a portion of which have roughened nucleation sites which readily nucleate and grow bubbles; and wherein the portion of tubing being heated, the heater located therein, and the filter are vertically disposed and substantially aligned with the secondary tank supply outlet to ensure that any released gas bubbles will rise into the air space of the secondary tank rather than travel downstream towards the filter where the gas bubbles could collect and impede the flow of ink therethrough.

13. An apparatus according to claim 12, wherein the heater is an immersible heater.

14. An apparatus according to claim 13, wherein the means for moving the liquid is a pump.

15. An apparatus for degassing a liquid ink in an ink supply system for an ink jet printer, comprising:

a main ink supply tank having an inlet and an outlet and having a supply of ink contained therein;

a printhead communicating with the main tank outlet by way of a flow path comprising a gas-impermeable tubing;

means for moving the ink along the tubing from the main tank to the printhead;

a secondary ink supply tank being located at a predetermined location relative to the printhead to ensure that a negative pressure is established at the printhead and being disposed between the main tank outlet and the printhead and being connected thereto by said tubing, the secondary tank receiving ink from the main tank and subsequently supplying ink to the printhead, the secondary tank having a base with a supply outlet therein, an inlet, an overflow outlet, and a top with a gas-permeable vent therein, the vent comprising a membrane which is impermeable to the ink, the secondary tank inlet and overflow outlet being disposed above the supply outlet and below the secondary tank top, so that a predetermined supply of ink is contained in the secondary tank with an air space formed thereover which is adjacent the secondary tank top, the secondary tank inlet communicating with the main tank outlet, the secondary tank supply outlet communicating with the printhead, and the secondary tank overflow outlet communicating with the main tank inlet for returning ink to the main tank when the ink in the secondary tank rises to said overflow outlet, so that the means for moving the ink cannot overfill the secondary tank; and a heater disposed at a position along the flow path between the secondary tank supply outlet and the printhead and adjacent the supply outlet for heating the ink to cause any dissolved or entrained gas in the ink to rise to the air space in the secondary tank and be removed therefrom by the vent in the secondary tank top.

* * * * *